United States Patent [19]

Birkle et al.

[11] Patent Number: 4,759,831

[45] Date of Patent: Jul. 26, 1988

[54] ELECTROPLATING APPARATUS PARTICULARLY FOR ELECTRO-DEPOSITION OF ALUMINUM

[75] Inventors: Siegfried Birkle, Hochstadt/Aisch; Johann Gehring, Spardorf, both of Fed. Rep. of Germany

[73] Assignee: Siemens Aktiengesellschaft, Berlin and Munich, Fed. Rep. of Germany

[21] Appl. No.: 33,263

[22] Filed: Apr. 2, 1987

[30] Foreign Application Priority Data

Jul. 4, 1986 [DE] Fed. Rep. of Germany ..... 3622554

[51] Int. Cl.[4] ..... C25D 5/00

[52] U.S. Cl. ..... 204/58.5; 204/225

[58] Field of Search ..... 204/58.5, 198, 202, 204/203, 225

[56] References Cited

U.S. PATENT DOCUMENTS

| | | | |
|---|---|---|---|
| 2,897,129 | 7/1959 | Dilling | 204/225 |
| 3,489,537 | 1/1970 | Cook | 204/39 |
| 4,053,383 | 10/1977 | Dotzer | 204/225 |
| 4,265,726 | 5/1981 | Herrnring et al. | 204/202 |
| 4,363,712 | 12/1982 | Birkle et al. | 204/199 |
| 4,415,422 | 11/1983 | Birkle et al. | 204/199 |
| 4,417,722 | 11/1983 | Ishii et al. | 266/250 |
| 4,425,211 | 1/1984 | Birkle et al. | 204/198 |

FOREIGN PATENT DOCUMENTS

| | | | |
|---|---|---|---|
| 0013874 | 3/1984 | European Pat. Off. . | |
| 0053676 | 3/1985 | European Pat. Off. . | |
| 0072969 | 6/1985 | European Pat. Off. . | |
| 0056844 | 8/1985 | European Pat. Off. . | |
| 1621054 | 4/1971 | Fed. Rep. of Germany . | |
| 2443361 | 4/1976 | Fed. Rep. of Germany | 204/198 |
| 2719680 | 11/1978 | Fed. Rep. of Germany . | |
| 3223224 | 12/1983 | Fed. Rep. of Germany . | |

*Primary Examiner*—T. M. Tufariello

*Attorney, Agent, or Firm*—Hill, Van Santen, Steadman & Simpson

[57] ABSTRACT

An electroplating apparatus having electroplating tank which is closable air-tight and charged with an inert gas above the electrolyte and also includes one vacuum lock for charging and discharging goods to be electroplated. The lock chamber of the vacuum lock is equipped with an inner lock door and an outer lock door and is preferably evacuated with the assistance of a vacuum pump so that solvent vapors can be condensed during evacuation in a condenser. The apparatus increases the useful life of the electrolyte, particularly an aprotic, aluminum-organic electrolyte which is used in aluminum plating in comparison to previously known locks which use gas and liquid locks.

12 Claims, 1 Drawing Sheet

ELECTROPLATING APPARATUS PARTICULARLY FOR ELECTRO-DEPOSITION OF ALUMINUM

BACKGROUND OF THE INVENTION

The present invention is directed electroplating apparatus, particularly for the electro-deposition of aluminum from an aprotic, oxygen-free and water-free aluminum-organic electrolyte. The apparatus includes an electroplating tank which is closable air-tight and is chargeable with an inert gas above an electrolyte in the tank. The tank has at least one lock for the inward and outward transfer of goods to be electroplated and the lock has at least one lock chamber which is equipped with an inner lock door and an outer lock door and is floodable with an inert gas.

Aluminum deposited from an aprotic, oxygen-free and water-free aluminum-organic electrolyte is distinguished by its ductility, low number of pores, resistance to corrosion and capability of anodic oxidation. Since the presence of air will cause a considerable reduction in the conductivity and in the useful life of this electrolyte due to the reaction with atmospheric oxygen and atmospheric humidity, the electroplating must be undertaken in a treatment apparatus operating under the exclusion of air. In order to prevent the contact of air during inward and outward transfer of the goods, charging and discharging locks are required. These locks are fashioned as gas locks, as liquid locks, and as combined gas-liquid locks and have conveying means for conveying the goods in the lock. German OS No. 27 19 680 discloses an electroplating apparatus for the electro-deposition of aluminum from an aprotic, oxygen-free and water-free aluminum-organic electrolyte, which apparatus has provided a lock chamber which is floodable with inert gas and an antechamber which is also floodable with inert gas so that an inward and outward transfer of goods to be electroplated can occur. The lock is fashioned as a gas lock and is thereby equipped with a total of three lock doors due to the division into the actual lock chamber and into an antechamber. The actual lock chamber is preferably operated with excess pressure so that no disturbing gases or atmospheric humidity can penetrate from the outside into the inert atmosphere which is maintained over the plating bath.

The lock design set forth in the above-mentioned German patent application is not capable of keeping air and humidity away from the electrolyte to an adequate degree. Therefore, it does not suppress the slow decomposition of the electrolyte.

U.S. Pat. No. 4,265,726, whose disclosure is incorporated with reference thereto and which corresponds to European Patent No. 0 013 874, discloses an apparatus for electro-depositing of aluminum wherein a lock system having a liquid lock is employed for the inward and outward transfer of the goods to be electroplated. This liquid lock is provided with an outer lock door and is proceded by an antechamber floodable with inert gas. A penetration of atmosperic oxygen and atmospheric humidity can be considerably reduced with such a lock system in comparison to an exclusive gas lock.

In the electroplating apparatus set forth in the above mentioned patent, the goods to be electroplated are on goods racks, are introduced into the electroplating tank with the assistance of an endless conveyor belt, are introduced from the antechamber floodable with inert gas through the liquid lock and into the plating bath and are then, in turn, transferred out of the electroplating bath in a reversed direction with the assistance of the same conveyor belt. A considerable entrainment of the electrolyte out of the electroplating tank and bath into the liquid lock, however, will occur. Due to the continuous contamination of the fluid of the liquid lock with the electrolyte and the unavoidable reaction with traces of humidity in the antechamber with the inert gas, the device cannot prevent reaction products from being formed and settling onto the clean goods during charging and preventing a subsequent deposition of a technically useable aluminum coatings.

In U.S. Pat. No. 4,363,712, whose disclosure is incorporated by reference and which corresponds to European Patent No. 0 053 676, an apparatus for electrodeposition of aluminum is disclosed. In this apparatus, a contamination of the pretreated goods to be electroplated is prevented in a liquid lock because a separate charging lock composed of an antechamber, liquid lock and a main chamber is separate from a discharging lock which, likewise, has an antechamber, liquid lock and main chamber.

It has turned out in practice that the certain qualities of atmospheric oxygen and atmospheric humidity will enter into the electroplating bath even given locks composed of an antechamber, liquid lock, and main chamber. This is because of entrainment of the oxygen and humidity with the goods to be electroplated into the electroplating bath and also occurs because of the continuous opening and closing of the lock doors. A certain reduction in the conductivity and in the useful life of the electrolyte will occur because of this contamination.

SUMMARY OF THE INVENTION

The object of the present invention is to create an electroplating apparatus which is suitable for the electro-deposition of aluminum from an aprotic, aluminum-organic electrolyte and which guarantees a practically oxygen-free and water-free operation for further enhancing the useful life of the electrolyte.

These objects are obtained in an improvement in an electroplating apparatus, particularly for the electrodeposition of aluminum from an aprotic, oxygen-free and water-free aluminum-organic electrolyte comprising an electroplating tank, a hood for the electroplating tank to render it closable air-tight, means for charging the space above the bath of electrolyte with an inert gas, at least one lock for the charging and discharging of goods into and out of the electroplating tank, and said lock having at least one lock chamber equipped with an inner door and an outer door and having means for flooding the chamber with an inert gas. The improvements are that the lock is constructed as a vacuum lock and has means for evacuating the lock chamber.

The invention is based on the perception that the low gas pressure can be produced in the lock chamber closed by the inner lock door and the outer lock door. These low gas pressures are significantly less than atmospheric pressure and particularly cause a drying and degasification of the goods being introduced into the apparatus. Differing from the lock system employed herebefore, water and oxygen are not partially displaced by an inert gas or an inert fluid, but are actively removed by generating a vacuum wherein the quantity of the residual water and residual oxygen can be reduced to extremely low values by the selection of a suitable low gas pressure. In addition to the considerable increase in the useful life of the electrolyte employed and of the economic feasibility of the electrodeposition of metal, a series of further advantages can also be achieved by employing a vacuum lock. Thus, significant steps of pre-treatment or after-treatment of the goods, as well as, for example a dewatering, drying and rinsing, can occur in the evacuatable lock chamber of the vacuum lock. A single vacuum lock can also be utilized as both the charging and discharging lock when the risk of contamination of the pre-treated goods can be suppressed during charging. Finally, it should also be emphasized that the emission of injurious solvent vapors such as, for example, toluol vapors, to the environment can be completely suppressed by the hermetic seal of the electrolyte.

In accordance with the preferred development of the invention, the vacuum lock is formed exclusively by the evacuatable lock chamber. As a result of the extremely high sealing effect of the vacuum lock, the preceding and following lock chambers can be eliminated.

As has already been mentioned, the vacuum lock can also serve as a charging and discharging lock so that the risk of contamination of the goods to be introduced does not exist here in contrast to other known liquid locks.

In comparison to other methods of generating a vacuum, it is particularly expedient when the lock chamber is evacuated with the assistance of a vacuum pump. A condensation means is preferably arranged between the vacuum pump and the lock chamber. Solvent vapors withdrawn from the lock chamber can, thus, be condensed in this condensation means, can be collected in their liquid state and can then be reused. It is thereby especially expedient when the condensate occurring in the condensate means is conveyable into an electroplating tank or into some other bath container of the electroplating apparatus which is chargeable with an inert gas.

In accordance with the further and especially preferred development of the invention, a spray means for spraying a rinsing fluid is arranged in the lock chamber. As a result thereof, cleaning measures can be carried out within the lock chamber, both before as well as after the electroplating operation. When the rinse fluid is thereby sprayed before the evacuation of the lock chamber, then the subsequent production of the vacuum simultaneously causes a drying of the goods.

Finally, it is especially advantageous when the lock chamber can also be flooded with ambient air. In this case, the evacuated lock chamber is flooded with ambient air before the outer door is opened. The flooding thus reduces the consumption of inert gas during a discharging operation.

The invention also specifies an expedient method for the operation of an electroplating apparatus equipped with a vacuum lock. It is thereby provided that for charging, the goods to be electroplated are first introduced into the lock chamber, the outer lock door is then closed and a vacuum is generated in the lock chamber and then after the vacuum has been generated, the evacuated lock chamber is then flooded with an inert gas. After flooding with inert gas, the inner lock door can be opened and the goods can then be conveyed from the lock chamber into the electroplating tank. By generating a vacuum and subsequent flooding with an inert gas, a penetration of atmospheric oxygen and atmospheric humidity into the electroplating tank can be reduced to extremely low quantities which are absolutely innocuous for the electrolyte.

After the electroplating operation, one then advantageously proceeds to discharge the goods with the completely electroplated goods being first introduced into the lock chamber, then the inner door is closed and a vacuum is generated in the lock chamber. After the vacuum has been generated, the lock chamber is then flooded with ambient air whereupon the outer door is open and the goods can be removed. Given such a procedure, the emission of injurious solvent vapors to the atmosphere can be suppressed.

When the goods to be electroplated are sprayed with a rinse fluid before generating the vacuum, then a drying of the cleansed goods is effected by the following evacuation. Here too, an emission of the vapors of the rinse fluid to the environment can be suppressed.

It is proven expressly expedient during operation of the electroplating apparatus when the vacuum having a gas pressure between 1 and $10^{-2}$ Torr is generated in the lock chamber. Given this range of gas pressure, first, a practical hermetic seal of the electrolyte is always obtained, and secondly, structural cost for stiffening of the lock chamber stressed by atmospheric pressure is still relatively low.

The electroplating apparatus equipped with at least one vacuum lock in accordance with the invention was developed for utilization in electro-deposition of the aluminum from aprotic, oxygen-free and water-free aluminum-organic electrolyte. Use, however, is to be basically recommended in all cases in which the electrodepositon of the organophilic metals from non-acqueous electrolyte which is to be protected against the excess of air and humidity is undertaken. As a result of the hermetic seal of the electrolyte, a greater flexibility than heretofore obtained also occurs for the selection of the appropriate solvent. Such for example as benzene can also be utilized.

Other advantages and features of the invention will be readily apparent from the following description of a preferred embodiment, the drawings and claims.

DESCRIPTION OF THE PREFERRED EMBODIMENTS

Figure 1:
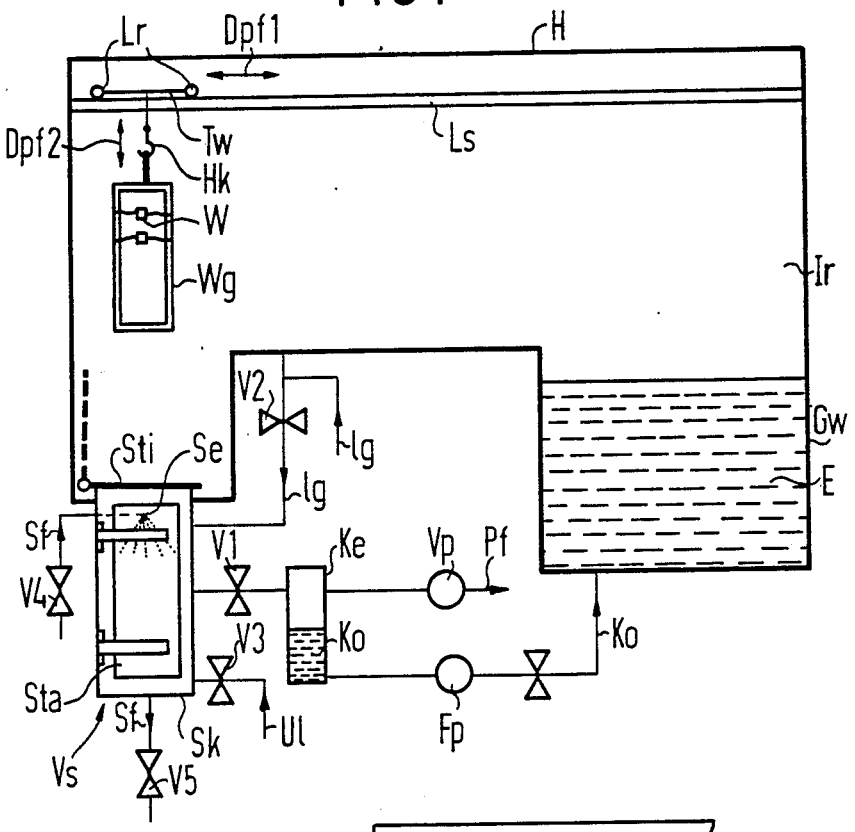
FIG. 1 is a greatly simplified schematic view of the functioning principles of an electroplating apparatus equipped with a vacuum lock.

The principles of the present invention are particularly useful when incorporated into an electroplating tank Gw in which an aprotic, oxygen-free and water-free, aluminum-organic electrolyte E is situated. The electroplating tank Gw is closed air-tight at the top by a hood H. The hood has means for charging with an inert gas, for example nitrogen, so that an inert gas will be above the electrolyte E in a space Ir so that in the apparatus the space above the hood H above the electrolyte will be filled with an inert gas. The hood and the inert gas space Ir also extends over a lock chamber Sk of a vacuum lock generally indicated at Vs. As may also be seen from FIG. 2, the lock chamber Sk comprises a horizontal, inner door Sti arranged within the inert gas space Ir and a vertical, outer lock door Sta arranged under the inert gas space Ir. The opened position of the lock doors Sti is shown in dot-dash lines in FIG. 1 and the opened position of the outer door Sta is shown in dot-dash lines in FIG. 2.

Horizontally arranged in the upper part of the hood H are running rails or tracks Ls which extend in this gas space Ir. A conveyor truck Tw is provided with running rollers Lr and is capable of being displaced on the running rails or track Ls in the direction of the double arrow Dpfl. A hook Hk is raised and lowered in the direction of the double arrow Dpf2 from the conveyor truck Tw and, as illustrated, is suspending a goods rack Wg on which goods W, which are to be plated, are secured.

The lock chamber Sk can be evacuated to a gas pressure of, for example, $10^{-1}$ Torr with the assistance of a vaccum pump Vp. The vacuum pump Vp is on a line extending to the chamber Sk, which line has a valve V1 which can be closed and opened. To condense solvent vapors, particularly toluol vapors, which are withdrawn from the lock chamber Sk, a condensation or condensor means Ke is arranged on the line between the valve V1 and the vacuum pump Vp, and this condensation means Ke has a corresponding cooling system which is not shown in great detail in the drawings. The condensate Ko produced in the condensation means Ke is conveyed into the electroplating tank Gw with the assistance of a liquid pump Fp. The gas from the lock chamber Sk, cleansed of the solvent vapor is, thus, completely innocuous and is emitted into the environment as indicated by an arrow Pf on a pressure or outlet side of the vacuum pump Vp.

The evacuated lock chamber Sk can be flooded with inert gas lg by opening a valve V2 which is on a line that extends from the chamber to the inert gas space Ir of the electroplating tank Gw. In addition, the chamber Sk can be flooded with ambient air U1 by opening a valve V3. The valve V2 is connected to the inert gas supply line of the inert gas space Ir so that after flooding the chamber Sk, the same pressure will prevail on both sides of the inner lock door Sti due to the connection of the inert gas space Ir. Thus, the inner lock door Sti can be easily opened.

Figure 2:
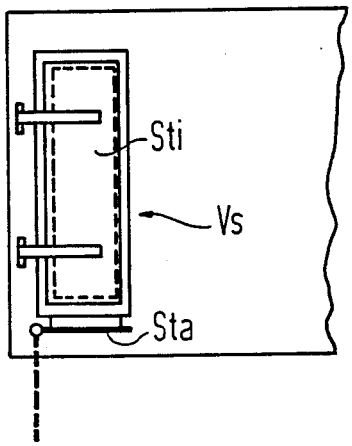
FIG. 2 is a plan view of the vacuum lock of the electroplating apparatus of FIG. 1.

A spraying means Se, which is shown in schematic fashion in FIG. 1, is arranged in a lock chamber Sk and rinse fluid Sf is capable of being sprayed via the spray means Se. The feed of the rinse fluid Sf is controlled by a valve V4 while the draining of the fluid from the chamber can be controlled by a valve V5.

The electroplating tank Gw contains equipment (not shown in greater detail in the drawing) for the electroplating of the goods W. In accordance with an example, the electroplating tank Gw can have an annular design such as disclosed in U.S. Pat. No. 4,415,422, whose disclosure is incorporated by reference and which corresponds to European Patent No. 0 056 844. This U.S. Patent also discloses an example of the equipment used for the electroplating of the goods W and a structure for a rotatable holding device for supporting and electrically contacting the goods rack Wg in an annular tank. In accordance with U.S. Pat. No. 4,425,211, whose disclosure is incorporated by reference and which corresponds to European Patent No. 0 072 969, the electroplating tank Gw can have a plurality of individual cells and, when warranted, aprotic, pre-treatment and after-treatment baths can also be arranged under the hood H. In this case, only a single vacuum lock can be utilized for charging and discharging instead of the two locks of the device in the patent. Instead of the goods W being arranged in the goods rack Wg, of course, bulk goods can also be aluminum plated with the electroplating apparatus of the present invention. In this case, the bulk goods for example are introduced into the electroplating tank Gw through a vacuum lock Vs in perforated drums and in turn are removed in a reverse direction. Vibrating conveyors, helical conveyors, conveyor belts and the like can also be utilized as conveying means for bulk goods to be aluminum plated.

A preferred operating mode of the electroplating apparatus described hereinabove is by the following steps:

1. Opening the outer lock door Sta;
2. Introducing of the goods W secured to a goods rack Wg into the lock chamber Sk, and closing the outer door;
3. Evacuating the chamber Sk by opening the valve V1 and turning the vacuum pump Vp on;
4. After reaching the desired pressure, such as a vacuum of $10^{-1}$ Torr, closing the valve V1 and shutting off the vacuum pump Vp;
5. Flooding the lock chamber Sk with inert gas lg by opening the valve V2;
6. Opening the inner door St1;
7. Transferring the goods rack Wg from the chamber into the electroplating apparatus by engaging the rack with a hook Hk and raising the rack out of the chamber and transporting it into a position above the bath and then lowering into the bath E;
8. Electroplating the goods W;
9. Removing the rack Wg from the electroplating tank Gw and introducing it back into the chamber Sk with the conveyor truck Tw;
10. Closing the inner door St1 and the valve V2;
11. Evacuating the chamber Sk by opening the valve V1 and turning on the vacuum pump Vp;
12. After reaching the desired vacuum of $10^{-1}$ Torr, closing the valve V1 and shutting off the vacuum pump Vp;
13. Flooding the lock chamber Sk with ambient air U1 by opening a valve V3; and
14. Opening the outer door St1 and removing the racks Wg with the aluminum plated goods W.

If desired, spray means Se can be utilized for pretreatment or after-treatment in the above method sequence. The toluol contained in the electrolyte E is thereby preferably employed as a rinse fluid Sf.

Although various minor modifications may be suggested by those versed in the art, it should be understood that we wish to employ within the scope of the patent granted hereon, all such modifications as reasonably and properly come within the scope of our contribution to the art.

We claim:

1. In an electroplating apparatus for electro-depositing aluminum from an aprotic, oxygen-free and water-free, aluminum-organic electrolyte, said apparatus including an electroplating tank, a hood on the electroplating tank to form an inert gas space above a bath of electrolyte in said tank, means for charging the space with an inert gas, at least one lock for charging and discharging of goods from the electroplating tank, said lock having a lock chamber equipped with an inner lock door and an outer lock door and means for flooding the lock chamber with an inert gas, the improvements comprising the lock chamber having means for evacuating the lock chamber so that the lock is fashioned as a vacuum lock, the means for evacuating the lock chamber include a vacuum pump with an outlet to the atmosphere, said vacuum pump being connected to the lock chamber by a line, said line having condensor means arranged between the vacuum pump and the lock chamber for condensing solvent vapors from a flow in said line.

2. In an electroplating apparatus according to claim 1, wherein the lock is exclusively a vacuum lock.

3. In an electroplating apparatus according to claim 1, which has a single lock acting both for charging and discharging goods from the apparatus.

4. In an electroplating apparatus according to claim 1, wherein the condensor means has a fluid line with a fluid pump extending to a container chargeable with inert gas, so that condensate in the condensor means can be moved to the container.

5. In an electroplating apparatus according to claim 1, wherein the lock chamber includes spray means for spraying a rinsing fluid on goods arranged in the lock chamber.

6. In an electroplating apparatus according to claim 1, wherein the lock chamber has means for flooding the chamber with ambient air.

7. A method for operating electroplating apparatus having an electroplating tank containing an electrolyte, a hood chargeable with inert gas, and a lock for introducing and removing goods to be electroplated, said lock having a lock chamber with an inner door extending to the electroplating tank and an outer door to the surrounding atmosphere, said method comprising introducing goods to be electoplated through the outer door into the lock chamber, closing the outer door, creating a vacuum in the lock chamber by removing any water vapors, gases, and solvent vapors from the lock chamber as a flow, removing all solvent vapors from the flow withdrawn from the lock chamber by condensing the solvent vapors from the flow and then discharging the gases; and water vapors of the flow to the atmosphere, after creating a vacuum of the desired amount, flooding the chamber with an inert gas, then opening the inner lock door to remove the goods from the lock chamber into the electroplating apparatus.

8. A method according to claim 7, which includes subsequent to the electroplating of the goods in the electroplating apparatus, moving the electroplated goods through the inner door into the lock chamber, closing the inner lock door, creating a vacuum in the lock chamber by withdrawing all the gas and solvent vapors therefrom, removing the solvent vapors from the gas by condensing and then discharging the gas to the atmosphere, after creating a vacuum in the lock chamber flooding the lock chamber with an ambient air and then opening the outer lock door for removing the goods from the lock chamber.

9. A method according to claim 8, which after the steps of introducing the electroplated goods into the lock chamber through the inner lock door and closing the inner lock door and before the step of creating a vacuum includes the step of spraying the electroplated goods with a rinsing fluid.

10. A method according to claim 9, wherein the step of creating the vacuum in each step comprises creating a vacuum having a gas pressure of between 1 and $10^{-2}$ Torr.

11. A method according to claim 8, wherein the step of creating the vacuum in both steps creates a vacuum having a gas pressure of between 1 and $10^{-2}$ Torr.

12. A method according to claim 7, wherein the step of creating the vacuum creates a vacuum with a gas pressure of between 1 and $10^{-2}$ Torr.

* * * * *